United States Patent [19]

Schleicher

[11] Patent Number: 4,554,872

[45] Date of Patent: Nov. 26, 1985

[54] ARRANGEMENT FOR REDUCING THE BASE DRAG IN PROJECTILES

[75] Inventor: Ulrich Schleicher, Hersbruck, Fed. Rep. of Germany

[73] Assignee: Diehl, GmbH & Co., Nuremberg, Fed. Rep. of Germany

[21] Appl. No.: 557,664

[22] Filed: Dec. 2, 1983

[30] Foreign Application Priority Data

Dec. 15, 1982 [DE] Fed. Rep. of Germany ..... 3246380

[51] Int. Cl.[4] ..... F42B 13/00

[52] U.S. Cl. ..... 102/490; 102/374

[58] Field of Search ..... 102/374, 380, 381, 490

[56] References Cited

U.S. PATENT DOCUMENTS

| | | | |
|---|---|---|---|
| 3,988,990 | 11/1976 | MacDonald, Jr. et al. | 102/380 |
| 4,104,969 | 8/1978 | Moll | 102/374 |
| 4,213,393 | 7/1980 | Gunners et al. | 102/374 |

FOREIGN PATENT DOCUMENTS

| | | | |
|---|---|---|---|
| 3142802 | 6/1982 | Fed. Rep. of Germany . | |
| 2522134 | 8/1983 | France | 102/490 |

*Primary Examiner*—Charles T. Jordan
*Assistant Examiner*—Ted L. Parr
*Attorney, Agent, or Firm*—Scully, Scott, Murphy & Presser

[57] ABSTRACT

An arrangement for reducing the base drag in projectiles constructed pursuant to the high-low pressure system including a gas-generating charge, a chamber with a pressure-reducing component, and a discharge aperture provided in the base wall. In the arrangement for the reduction of the base drag in projectiles, the charge is annularly shaped, the pressure-reducing component is formed as a tube axially extending through the charge and possesses a multiplicity of nozzles. Through the provision of the large number or multiplicity of nozzles, the tube, which separates the high-pressure space from the low-pressure space, a relatively gentle gas jet exits from the bottom of the projectile. For this purpose, of significance is the swirling of the individual gas jets in the low-pressure space in accordance with the principle of the countercurrent process. The vacuum in the region of the projectile base is reduced to a minimum due to the gentle jet.

6 Claims, 4 Drawing Figures

ARRANGEMENT FOR REDUCING THE BASE DRAG IN PROJECTILES

BACKGROUND OF THE INVENTION

1. Field of the Invention

The present invention relates to an arrangement for reducing the base drag in projectiles constructed pursuant to the high-low pressure system including a gas-generating charge, a chamber with a pressure-reducing component, and with a discharge aperture provided in the base wall.

2. Discussion of the Prior Art

Known from German Laid-open Patent Application No. 31 42 802 is an arrangement which provides for a reduction in the base drag of projectiles. Combustion gases are generated in a chamber under a relatively high pressure. These gases exit the chamber through a nozzle at critical flow velocities. An arrangement throttles the flow. The gases then exit from the bottom surface of the projectile with an extremely low velocity. The above-mentioned arrangements are arranged in series, as a consequence of which the spatial requirement becomes relatively high.

SUMMARY OF THE INVENTION

Accordingly, it is an object of the present invention, in an improvement upon the structure disclosed in German Laid-open Patent Application 31 42 802, to provide an arrangement which demands extremely little space.

The foregoing object is achieved through the provision of an arrangement for the reduction in the base drag of projectiles of the type described hereinabove in which the charge is annularly-shaped, the pressure-reducing component is formed as a tube axially extending through the charge and possesses a multiplicity of nozzles. Through the provision of the large number or multiplicity of nozzles in the tube, which separates the high-pressure space from the low-pressure space, a relatively gentle gas jet exits from the bottom of the projectile. For this purpose, of significance is the swirling of the individual gas jets in the low-pressure space in accordance with the principle of countercurrent flow. The vacuum in the region of the projectile base is reduced to a minimum due to the gentle jet.

The foregoing is assisted in that the gentle jet evidences a relatively large flow cross-section.

In accordance with a further feature of the invention, there is provided a space-saving solution for the ignition of the gas-generating charge. Pursuant to further features of the invention, there are provided constructively simple and space-saving arrangements for the closure of the ignition apertures.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
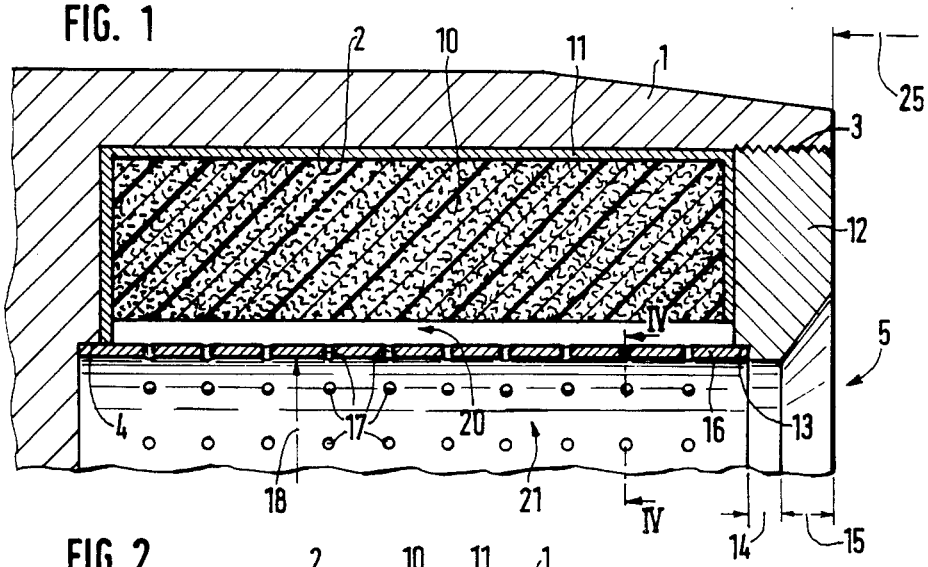
FIG. 1 illustrates a sectional view through an arrangement for the reduction in the base drag of a projectile.

A projectile base 1 of an artillery projectile (not disclosed in detail) in accordance with FIG. 1 possesses a chamber 5 which is provided with a recess 2, a screw thread 3, and a recess 4. Located within the recess 2 is a gas-generating charge 10 with a heat-insulating layer 11. The charge 10 is retained in place by a closure cover 12. The closure cover 12 includes a recess 13, a cylindrical opening cross-section 14, and a funnel-shaped portion 15. A tube 16 is positioned in the recesses 4 and 13, and is provided with a multiplicity of nozzles 17. The tube 16 defines the high-pressure region 20 and the low-pressure region 21 within the chamber 5. The internal diameter of the tube 16 and that of the cylindrical section 14 are equal in size. The ignition or detonation of the charge 10 is effected during the acceleration of the projectile interiorly of the weapon barrel (not shown). The hot propellant gases stream through the nozzles 17 and ignite the charge 10. The pressure drop-off of the propellant gas, which will occur when the projectile has exited from the weapon barrel, has essentially no influence over the burning down of the charge 10, since the nozzles reduce the pressure fluctuations to a minimum in the region at the mouth of the muzzle. Besides the muzzle explosive gases, the nozzles which are streamed through at sonic speed, serve the purpose that the charge can steadily burn down in the high-pressure region 20 at relatively high gas pressure (P20>>P21). Oppositely directed gas jets exit through the nozzles 17, and are expanded and swirled within the low-pressure region 21.

The gas jet which exits from the cylindrical portion 14 is still further expanded in the conical portion 15, and then enters at a relatively low speed into the subpressure or vacuum region 25 at the base end of the projectile.

Figure 2:
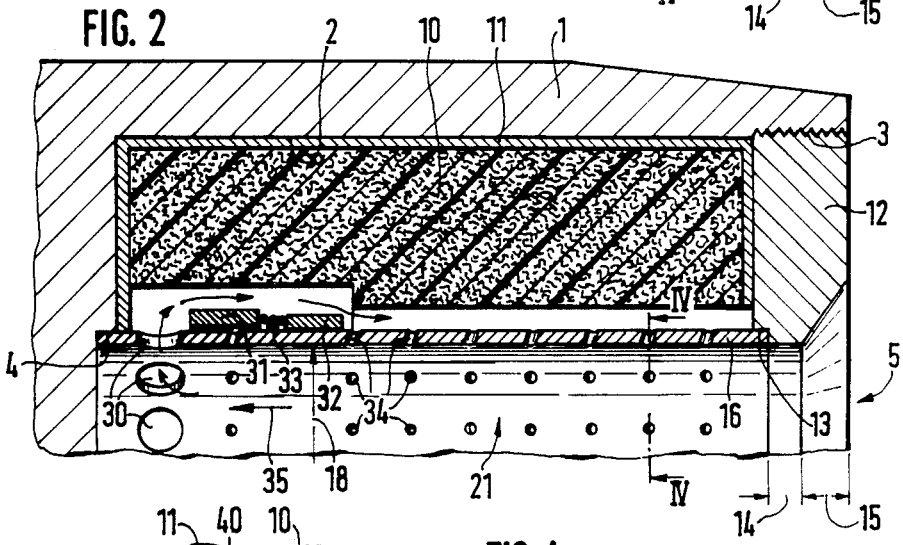
FIG. 2 illustrates a second embodiment of the arrangement pursuant to the invention.
Figure 4:
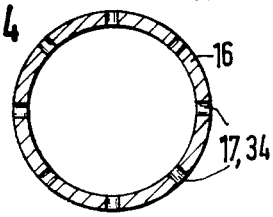
FIG. 4 is a transverse cross-sectional view through the arrangements of FIGS. 1 and 2.

In accordance with FIG. 2, provided in the tube 16 are relatively large ignition apertures 30 which are oriented in a direction towards the projectile tip (not shown). These apertures 30 can be closed off through a slider 31. Serving this purpose is a spring 33 supported on a ring 32 which is fixed to the tube. Nozzles 34 are provided in the tube 16, which are angled in a direction facing towards the tip of the projectile. The arrangement of the nozzles 34 correspond to the representation as shown in FIG. 4 of the drawings.

During the acceleration of the projectile in the weapon barrel, the slider 31 assumes the position illustrated in FIG. 2 of the drawings. This causes the spring 33 to be stressed. When the projectile has exited from the weapon barrel; in effect, the accelerating phase of the projectile is completed, the spring 33, as well as the force due to inertia, presses the slider 31 in the direction of arrow 35, until the apertures 30 are closed off. As long as the apertures 30 are open, it is possible that the propellant charge gases are able to enter almost unhindered into the high-pressure region 20 and to ignite the gas-generating charge 10. The other functions correspond to the sequence which have been described with regard to FIG. 1.

Figure 3:
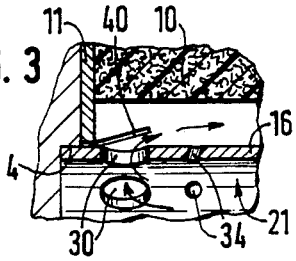
FIG. 3 is a fragmentary sectional view of an arrangement which is modified with respect to that disclosed in FIG. 2.

In accordance with FIG. 3 of the drawings, a flutter valve 40 is associated with each of the apertures 30. During the accelerating phase of the projectile within the weapon barrel, as a result of which there accordingly reigns the propellant gas pressure in the low-pressure region 21, the flutter valves 40 will open whereby the hot propellant gases can ignite the gas-generating charge 10. After the projectile has exited from the weapon barrel, and thereby the gas pressure of the propellant charge has dropped off, the flutter valves 40 close off the apertures 30. Consequently, a corresponding gas pressure can build up in the high-pressure region 20.

I claim:

1. An arrangement for reducing base drag of an artillery projectile comprising:

a body including an annular chamber and a discharge aperture in communication therewith;

an axially extending tube located in the chamber and separating the chamber into an outside region radially outside the tube and an inside region radially inside the tube, said inside region being in fluid communication with the discharge aperture; and an annularly-shaped detonatable gas generating charge located in the outside region;

the tube including (i) a plurality of inlet nozzles for conducting gas radially outward from the inside region to the outside region to detonate the gas generating charge, and (ii) a plurality of outlet nozzles for conducting gas from the outside region into the inside region;

the tube restricting the flow of gas from the outside region to the inside region after detonation of the gas generating charge to facilitate maintaining a low pressure in said inside region;

further comprising flow control means connected to the tube and selectively opening and closing the inlet nozzles to control the flow of gas therethrough.

2. An arrangement according to claim 1 wherein the flow control means comprises:

ring means fixed on the tube;

sliding means supported on the tube for sliding movement across the inlet nozzles to selectively open and close the inlet nozzles; and spring means connecting the sliding means to the ring means and biasing the sliding means to a position closing the inlet nozzles;

the inertia of the sliding means forcing the sliding means against the spring means to a position opening the inlet nozzles during forward accelaration of the tube.

3. An arrangement according to claim 1 wherein the control means includes a plurality of flutter valves located adjacent the inlet nozzles to selectively open and close the inlet nozzles, the flutter valves being biased to positions closing the inlet nozzles, and moving to positions opening the inlet nozzles when the pressure in the inside region exceeds the pressure in the outside region by a perdetermined amount.

4. An arrangement according to claim 1 wherein:

the body includes a forward recess receiving a front end of the tube and aligning the tube in the chamber; and the body comprises a closure cover including the discharge opening, a rearward recess receiving a back end of the tube, and an annular shoulder radially extending rearward of the tube to hold the tube in the chamber.

5. An arrangement according to claim 1 wherein the tube defines a longitudinal axis, and the inlet and outlet nozzles extend through the tube perpendicular to said longitudinal axis.

6. An arrangement according to claim 1 wherein the body has a forward end, and the inlet and outlet nozzles slant radially inwardly toward said forward end.

* * * * *